United States Patent [19]

Roseberg et al.

[11] 4,121,775

[45] Oct. 24, 1978

[54] PULVERIZER

[76] Inventors: Harry G. Roseberg, 3101 S. Barrington St., Los Angeles, Calif. 90066; Bernard Levine, 2233 Lomita Blvd., Lomita, Calif. 90717

[21] Appl. No.: 841,367

[22] Filed: Oct. 12, 1977

Related U.S. Application Data

[63] Continuation-in-part of Ser. No. 701,104, Jun. 30, 1976, abandoned.

[51] Int. Cl.[2] ..... B02C 19/08

[52] U.S. Cl. ..... 241/30; 241/169.2; 241/199.9; 241/DIG. 27

[58] Field of Search ..... 241/27, 30, 168, 169, 241/169.1, 169.2, 199, 199.9, 199.4, 199.12, DIG. 27

[56] References Cited

U.S. PATENT DOCUMENTS

| | | | |
|---|---|---|---|
| 2,572,378 | 10/1951 | Paul | 241/199.9 |
| 2,631,786 | 3/1953 | Morgan | 241/169 |
| 3,915,393 | 10/1975 | Elkins | 241/168 |

FOREIGN PATENT DOCUMENTS

| | | | |
|---|---|---|---|
| 1,001,879 | 1/1957 | Fed. Rep. of Germany | 241/199 |
| 1,203,100 | 10/1965 | Fed. Rep. of Germany | 241/DIG. 27 |
| 461,667 | 1/1971 | Japan | 241/199 |

*Primary Examiner*—Howard N. Goldberg
*Attorney, Agent, or Firm*—Poms, Smith, Lande & Glenny

[57] ABSTRACT

A pulverizer generally includes a bowl for receiving an object to be pulverized and a pestle movable into the bowl for pulverizing the object. This system has been improved by providing a container which has a depression similar in shape to the shape of the bowl which is received in the bowl and the object is pulverized in the depression of the container to prevent the pulverized material from contaminating the bowl. The container has a flap for covering the depression to hold the pulverized material in the depression. The flap is folded over the depression and locked by a suitable locking mechanism. The pestle has a generally convex but truncated downwardly facing surface which generally conforms to the upper surface of the bowl over the major portion of the exterior, and the bottom surface of the pestle is spaced from the bottom surface of the bowl when the pestle is mated in the bowl. A projection extends from the bottom of the pestle for localizing forces from the pestle for initially cracking hard objects, and the projection extends to the bottom surface of the bowl when the major portion of the pestle contacts the upper surface of the bowl. The pestle is rotated by a motor and it is mounted on a support which permits the pestle to be angled in the bowl.

19 Claims, 6 Drawing Figures

PULVERIZER

RELATED APPLICATION

This is a continuation-in-part of application Ser. No. 701,104 filed June 30, 1976, now abandoned.

BACKGROUND OF THE INVENTION

This invention generally concerns a pulverizer which has its principal application in crushing and pulverizing small objects, especially medical tablets and pills.

Certain patients have difficulty swallowing standard medication. For example, many children have difficulty swallowing tablets, and many mental patients refuse to swallow them. At one time, many medications could be obtained in bulk form, but now most drugs are supplied in dosage amounts. Therefore, many hospitals must crush and pulverize dosage forms of drugs prior to administering them to patients. Conventionally, a mortar and pestle is used and the powder is usually stored in small paper cups until administered to the patient.

This method, however, has significant problems. First, the mortar and pestle both must be cleaned after every use or both would become contaminated with different drugs. Second, there is danger of losing some drug in the transfer between the mortar and the paper cup, and in some instances, this can result in improper dosage to the patient. Third, a mortar and pestle is slow and difficult to use especially with coated tablets which are difficult to crack initially without causing loss of part of the object.

Therefore, it is an object of the present invention to solve the above-mentioned problems. Particularly, the following are objects of the invention: to prevent the mortar from becoming contaminated with drugs; to prevent possible loss of medication in the transfer between a mortar and a container; to provide a pulverizer that is fast and simple to use; to crack hard coated objects with minimal effort and without risk of losing material from the mortar; and to pulverize hard objects to a fine powder.

SUMMARY OF THE INVENTION

These and other objects of the invention are accomplished by having a pulverizer which includes a pestle movable into a bowl, and further includes a container having a depression similar in shape to the bowl. The depression fits into the bowl and the object to be pulverized is placed in the depression and pulverization takes place in the depression to prevent the pulverized material from contaminating the bowl. The container has a cover for covering the depression to hold the pulverized material in the depression. The cover may be an integral portion of the container which folds over the depression to cover it and hold the pulverized material therein. The cover could include a lock for locking the cover over the depression.

Generally, the depression has a shape similar to the pestle but this may be modified somewhat for optimum pulverization. For example, the pestle may be of a generally convex but have a truncated downwardly facing surface which generally conforms to the upper surface of the bowl over the major portion of the pestle exterior with the pestle bottom being spaced from the bottom surface of the bowl when the pestle is mated in the bowl. This space is where most of the grinding takes place and the pulverized material tends to be sealed in the space by the contact along the upper surface of the bowl by the major portion of the pestle. The pestle may also include a projection extending from the bottom of the pestle for localizing forces from the pestle for initially cracking hard objects. Preferably, the projection extends to the bottom surface of the bowl when the major portion of the pestle contacts the upper surface of the bowl.

Some angling of the pestle may be desirable to ensure that all material is completely pulverized. The angling permits the sides of the pestle to approach the sides of the bowl at all locations where material is present.

In the following discussion, it will be recognized that the exemplary embodiment was developed primarily to pulverize drugs in tablet and pill form. However, it will readily be seen that the device of the present invention has great utility in pulverizing other solid objects.

Figure 1:
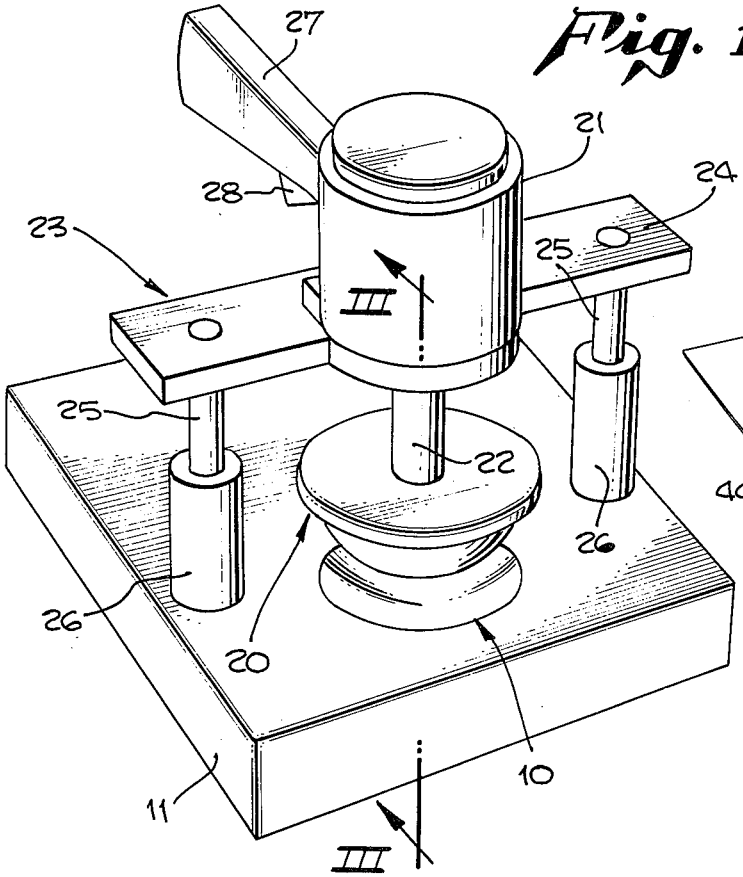
FIG. 1 is a perspective view of the pulverizer of the present invention showing the pestle mounted on a motor and held in a stand, the stand also having a bowl therein.

DETAILED DESCRIPTION OF THE PREFERRED EMBODIMENT:

The pulverizer of the present invention comprises generally a bowl 10 and a pestle 20 movable into the bowl. In the first exemplary embodiment (FIG. 1), the bowl 10 is formed in a base 11. Pestle 20 is mounted for rotation on the motor 21 by connection with the shaft 22. The motor may operate on batteries, or it may be connected by a cord to a power supply. A handle 27 may be provided for holding the motor, and a trigger switch 28 actuates the motor. A switch sensitive to pressure on the pestle could be provided.

In the second exemplary embodiment, the motor 21A has switch 28A mounted thereon. No handle is shown, but one may be provided. The bowl and pestle are unchanged.

Motor 21 is mounted on a suitable mounting means 23 (FIG. 1) or 23A (FIG. 6) which in the first exemplary embodiment comprises a mounting bar 24 which is mounted on shafts 25 which telescope into and out of members 26. Preferably, a spring is mounted in each of the members 26 biased against shafts 25 to bias the bar 24 and the motor 21 upward. Motor 21 is mounted to the bar 24 in a manner which allows angling of the pestle in the bowl. This mounting could take the form of many conventional mounts which allow the desired degrees of freedom.

The second embodiment shows such a mounting. Motor 21A is mounted on support 26A which is formed of spring steel. Foot 24A is fastened by screws 19 or by welding to base 14. Portion 27A fits into member 29A to support the motor. The bend between support 26A and portion 27A is flexible because of the spring steel. Portion 27A can be removed from member 29A to remove the motor. The spring steel allows all desired degrees of freedom. For example, movement in the z direction is achieved by flexing support 26A. Angling along the x axis is accomplished by flexing the bend between support 26A and portion 27A. The resiliency also permits movement along the y axis alone or simultaneously with movement in the other directions. If desired, arm 27A could be welded or fastened directly to motor 21A.

In the second embodiment, base 19A is mounted on base 14 which is similar to base 11 of the first embodiment with bowl 10. Base 19A could be removably secured to base 14 with a guide or the like, by suction or magnetism, it could be completely removable or it can be fixed. The removability feature of base 19A also permits angling of the bowl relative to the pestle.

Figure 6:
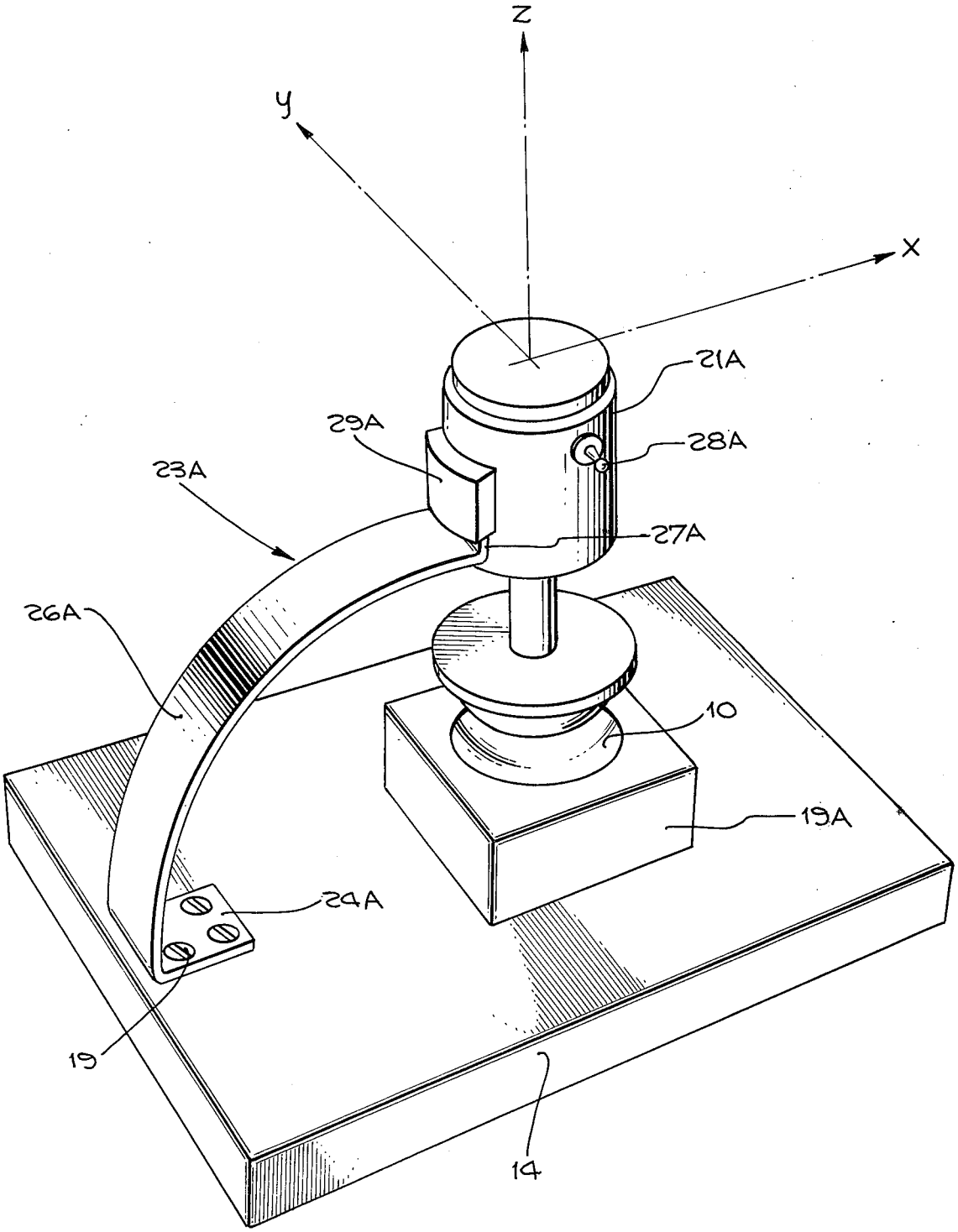
FIG. 6 is a perspective view of the modified pulverizer of the present invention.

The motor and the associated pestle could be portable relative to the base. In the exemplary embodiments, the motor is mounted as shown to keep the pestle and bowl together. The motor could be removable from the mounting means as shown in FIG. 6, and pulverization could occur without the support 23A.

Figure 2:
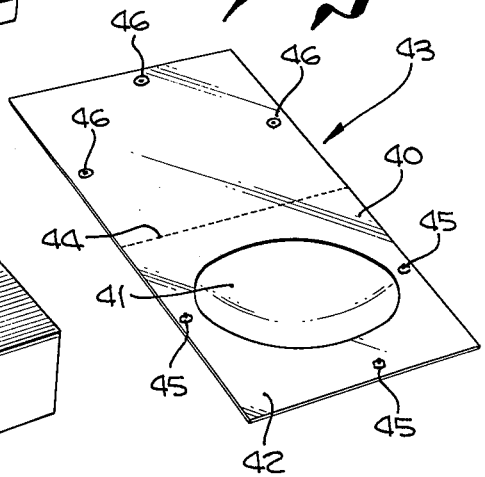
FIG. 2 is a perspective view of the container in which pulverization takes place and where the pulverized material may be stored after grinding.
Figure 3:
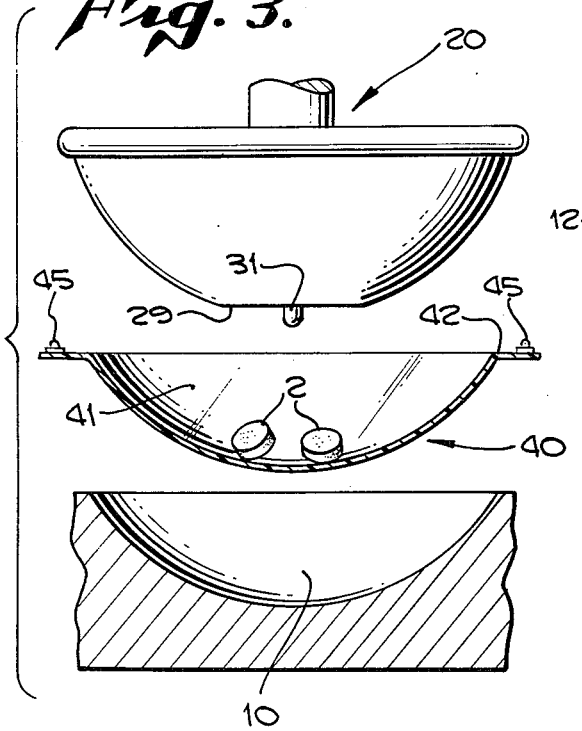
FIG. 3 is an exploded sectional view taken through the plane III—III in FIG. 1 and shows how the pestle, container and bowl fit together.

Container means having a depression similar in shape to the bowl is received in the bowl for receiving the object to be pulverized whereby pulverization takes place in the depression to prevent the pulverized material from contaminating the bowl. In the exemplary embodiment, the container means is shown generally in FIG. 2, and its interaction with other structure is shown in more detail in FIGS. 3, 4 and 5. The container means 40 includes a depression 41 in a relatively flat piece of material 42. As shown in FIG. 3, the depression 41 is received in the bowl 10 for receiving the object 2 to be pulverized.

The container 40 is formed of plastic in the preferred embodiment. The container material should be chosen so that it is not porous and is tough enough to resist being ground excessively by the pestle and the pulverized material. Although grinding takes place between the pestle and the surface of the plastic a very tough plastic may not be necessary for the one time use of the container. The material need not be thick enough to hold a shape because in the exemplary embodiment, the depression 41 will naturally conform to the shape of the bowl 10. However, it is also contemplated that pulverization may take place out of the bowl. For example, if the motor 21 and pestle 20 are removable from the mounting means 23, the person desiring to grind an object may merely place the object in the depression 41, place the container in his hand and use his hand as a substitute for a base. In that instance, it may be desirable to have a more rigid plastic to hold a particular shape although in the absence of more rigid containers, the palm of the hand may form a suitable bowl.

The container has a covering means for covering the depression to hold the pulverized material in the depression. The covering means may comprise an integral portion of the container means for folding over the depression to cover it and hold the pulverized material therein. In FIG. 2 in the preferred embodiment, the covering means is shown generally at 43. The cover 43 is generally folded over at dotted line 44 to cover the depression 41. If the container 40 is made out of flexible material, no provision will have to be made in the container to allow for folding since the relatively flexible material can easily fold. However, as the material becomes more rigid, a conventional plastic hinge may have to be formed between the covering means 43 and the rest of the container to allow for proper folding. Having a cover which is an integral portion of the container is advantageous because it keeps the container and its cover together.

Locking means on the container means locks the covering means over the depression. As shown in FIG. 2, in the preferred embodiment the locking means comprise locking pins 45 which fit into dimples 46 and are frictionally held therein. Other selfcontained locking devices such as adhesives mounted on the container means may replace the locking means of the exemplary embodiment. A self-contained locking mechanism such as the one shown in FIG. 2 in the exemplary embodiment or such as selfcontained adhesives is preferred over the use of tape or staples or the like because those elements introduce the necessity of having staplers or tape dispensers which can slow down the user and staples and loose tape can fall into food or water.

Figure 4:
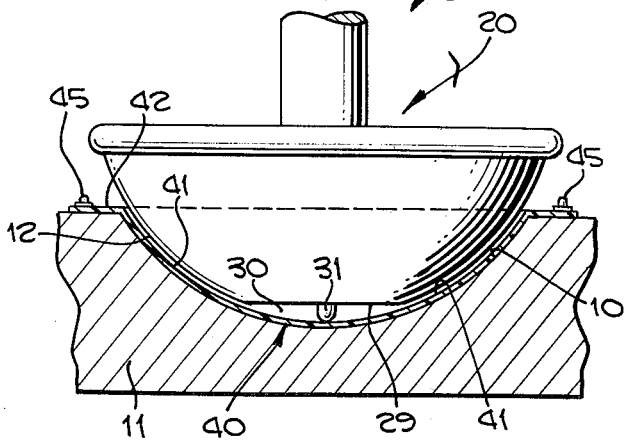
FIG. 4 shows the container in the bowl and the pestle mated in the container.
Figure 5:
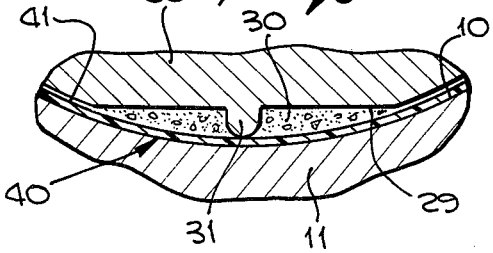
FIG. 5 is a detailed view showing the projection intersecting the bottom of the bowl and the space between the truncated bottom of the pestle and the bottom of the bowl where material is pulverized.

Referring again to the pestle 20, the pestle has a generally convex truncated downwardly facing surface which is generally shown in FIGS. 3 and 4. The surface of the pestle conforms to the upper surface of the bowl over the major portion of its exterior with the pestle bottom being spaced from the bottom surface of the bowl when the pestle is mated in the bowl. As stated above, the container generally conforms to the shape of the bowl so that the interaction of the pestle and the container shown in FIG. 4 would be the same interaction the pestle would show with the bowl if the container were removed. The pestle 20 conforms to the upper surface of the bowl at 12 as shown in FIG. 4. However, the convex shape of the pestle is truncated at 29 which leaves a space 30 between the pestle bottom and the bottom surface of the bowl when the pestle is mated in the bowl. See FIGS. 4 and 5. By providing a space, the rotating pestle is better able to effectively pulverize materials. It is believed that the space prevents the binder in tablets and pills to reform the pulverized material into a solid object. The space also tends to localize the pulverized material to maintain it within the bowl or container.

A projection extends from the bottom of the pestle for localizing forces from the pestle for initially cracking hard objects. As stated above, coated tablets are often difficult to crack in a conventional mortar and pestle. With the present invention, the projection 31 shown in the exemplary embodiment in FIGS. 3 through 5 has proved extremely effective in initially cracking hard tablets because the entire force from the pestle can be localized over one small area of the tablet to break the hard shell. Once cracking takes place, grinding usually occurs in the normal manner.

The projection extends to the bottom surface of the bowl when the major portion of the pestle contacts the upper surface of the bowl and the projection extends to the bottom of the container when the major portion of the pestle contacts the upper surface of the container. In the exemplary embodiment shown in FIGS. 4 and 5, if the projection were longer, it could extend through the container before grinding could take place between the major portion of the pestle and the upper walls of the container. Grinding would be limited, in effect, to the small area below the projection 31. Too short a projection may prevent contact between the projection and the hard object to prevent cracking thereof.

Pulverization takes place in the following manner. The container 40 is located in the bowl 10. An object 2 is placed in the container as shown in FIG. 3. The pestle 20 is moved into container 40 into contact with the object (FIG. 4) and pestle 20 is rotated by motor 21 relative to container 40 to pulverize the object in the container. After pulverization, pestle 20 is removed from container 40 and cover 43 is folded over the depression 41 to seal the pulverized material in the container. Thereafter, if desired the cover 43 can be locked into place over depression 41 so that the pulverized material is secured in the depression.

In order to improve pulverization of the material, the pestle can be rocked back and forth and from side to side on spring mounts 23A. Also, although somewhat bulkier, the container and bowl can be rotated relative to a stationary pestle, and either the bowl or the pestle may rock relative to the other. However, it is simpler to rotate the pestle because of its smaller size and because rotation of the bowl might cause the pulverized powder material to fly out of the bowl or container.

After grinding one drug, nothing must be done to the bowl as it will not be contaminated. However, the pestle should be cleaned. If the motor 21 is removable from its mount 23, a cloth containing solvent is brought next to pestle 20 and the motor can be actuated so that the rotating pestle cleans itself against the cloth.

One contemplated modification of the present invention is to have the base have many bowls therein. These could be arranged in a circular pattern with the motor on a single post so that the pestle could be pivoted to each bowl. Because the pestle and its motor do not have to be mounted on a stand, the bowls could be arranged in any desired pattern and the pestle could be moved into any bowl. It is also contemplated that containers could be provided with multiple depressions located to fit into a plurality of bowls in the base. Separate covers could be provided for each depression or a larger cover could cover more than one depression at a time.

It will be understood that various modifications and changes may be made in the configuration described above which may come within the spirit of this invention, and all such changes and modifications coming within the scope of the appended claims are embraced thereby.

We claim:

1. In a pulverizer comprising a bowl for receiving an object to be pulverized and a pestle movable into the bowl for pulverizing said object,and means for rotating the pestle relative the bowl the improvement comprising:

container means for containing a pulverized object and having a depression conforming to the bowl, the depression being received in the bowl for receiving the object to be pulverized whereby pulverization takes place in the depression to prevent the pulverized material from contaminating the bowl and is contained in the depression thereafter until dispensed from the container means for its intended use, the pestle comprising a generally convex, truncated downwardly facing surface which generally conforms to the upper surface of the container means over the major portion or its exterior with the pestle bottom being spaced from the bottom surface of the container means when the pestle is mated in said bowl, the pestle further comprising projection means extending from the bottom of the pestle for localizing force from the pestle for initially cracking hard objects.

2. The improvement of claim 1 wherein the projection extends to the bottom surface of the container means when the major portion of the pestle contacts the upper surface of the bowl.

3. The improvement of claim 1 wherein the container means includes a covering means for covering the depression to hold the pulverized material in the depression.

4. The improvement of claim 3 wherein the covering means comprises an integral portion of the container means for folding over the depression to cover it and to hold pulverized material therein.

5. The improvement of claim 4 further comprising lock means on the container means for locking the covering means over the depression.

6. The improvement of claim 3 further comprising lock means on the container means for locking the covering means over the depression.

7. The improvement of claim 1 wherein the depression has a shape generally the same as the shape of the pestle.

8. The improvement of claim 1 further comprising pestle mounting means for mounting the pestle for angling with respect to the bowl.

9. The improvement of claim 8 wherein the pestle mounting means comprises resilient arm means operably connected to the bowl and to the pestle to angle the pestle against the resiliency of the resilient arm means.

10. The improvement of claim 9 further comprising releasable mounting means attached to the pestle for releasably mounting the pestle on the resilient arm means.

11. In a pulverizer comprising a bowl for receiving an object to be pulverized, a pestle movable into the bowl for pulverizing the object and means to rotate the pestle relative to the bowl, the improvement comprising the provision of:

the pestle comprising a generally convex, truncated downwardly facing surface which conforms to the upper surface of the bowl over the major portion of its exterior with the bottom of the pestle being truncated so that the bottom of the pestle is spaced from the bottom surface of the bowl, the pestle further comprises projection means extending from the bottom of the pestle for localizing force from the pestle for initially cracking hard objects.

12. The improvement of claim 11 wherein the projection extends to the bottom surface of the bowl when the major part of the pestle contacts the upper surface of the bowl.

13. The improvement of claim 11 further comprising pestle mounting means for mounting the pestle for angling with respect to the bowl.

14. The improvement of claim 13 wherein the pestle mounting means comprises resilient arm means operably connected to the bowl and to the pestle to angle the pestle against the resiliency of the resilient arm means.

15. The improvement of claim 14 further comprising releasable mounting means attached to the pestle for releasably mounting the pestle on the resilient arm means.

16. A method of pulverizing an object comprising:

(a) locating a container in a bowl;

(b) placing the object to be pulverized in the container;

(c) moving a pestle into the container and moving a projection extending from the bottom of the pestle into contact with the object; and (d) rotating the pestle relative to the container to pulverize the object in the container.

17. The method of claim 16 comprising the further steps of removing the pestle from the container and covering the container to hold the pulverized material in the container.

18. The method of claim 16 further comprising the steps of removing the pestle from the container after the object is pulverized and then folding part of the container over the part of the container holding the pulverized material to maintain the pulverized material in the container.

19. The method of claim 18 further comprising the step of locking the part of the container in the folded over position so that the folded over portion is locked over the part of the container holding the pulverized material.

* * * * *